United States Patent [19]

West et al.

[11] Patent Number: 4,829,983

[45] Date of Patent: May 16, 1989

[54] BURNER MOUNTING BRACKET

[76] Inventors: Eugene L. West, 1349 Eastlawn SE., Grand Rapids, Mich. 49506; Mark Taylor, 5867 Appleview Dr., SE., Kentwood, Mich. 49508

[21] Appl. No.: 49,724

[22] Filed: May 12, 1987

[51] Int. Cl.[4] ..... F24H 1/00

[52] U.S. Cl. ..... 126/363; 122/14; 126/350 R

[58] Field of Search ..... 126/344, 350 R, 361, 126/363; 431/343; 122/13 R, 14

[56] References Cited

U.S. PATENT DOCUMENTS 1,828,023 10/1931 Brill ..... 126/350 R 3,163,159 12/1964 Buehl et al. ..... 126/363

*Primary Examiner*—Randall L. Green

*Attorney, Agent, or Firm*—Austin R. Miller

[57] ABSTRACT

A heavy gauge sheet metal burner mounting bracket for supporting a burner mounting arm including a base and a support member extending upwardly from the base and having a plurality of holes extending therethrough which are positioned to receive a portion of the mounting arm, the support member having a plurality of tabs extending therefrom to fix a radiation shield in a desired position above the base.

5 Claims, 3 Drawing Sheets

BURNER MOUNTING BRACKET

FIELD OF THE INVENTION

This invention relates to a burner mounting bracket for use within the combustion chamber of a water heater to mount removably a gas burner in desired positions so that heat and combustion products may flow in predetermined paths within the water heater.

It is important in the design and manufacture of gas fired water heaters that the burner mechanism be precisely placed within the combustion chamber. This is especially true because of the potentially hazardous flue gas combustion products that result from the burning of natural or propane gas.

A major hazard associated with the use of gas is the potentially toxic fumes created. It is wholly undesirable for carbon monoxide gas, which is a product of combustion, to collect within a confined area such as a basement where water heaters are typically located.

It has been found that brackets frequently bend over or break during construction of the water heater at the manufacturing site or during installation because of the tendency of workers to physically force the burner components together. Also, the brackets are subjected to a variety of stresses and torques during shipment due to rough handling and poor roads. Furthermore, it has been found that service personnel often inadvertently shift the bracket while performing maintenance or repairs. This destroys the critical alignment that is needed between the burner and the flue(s).

Many water heaters utilize a mounting arm to keep the burner in the proper position. This arrangement is also inadequate. The cost of the mounting arm is high because it must be strengthened to support not only itself but the burner. Furthermore, the base of the mounting arm must be designed so as to be firmly mounted to the combustion chamber wall. Since most commercial and domestic water heaters are mass produced, it is important to minimize unit production costs by simplifying design.

Also, the burner arm is highly susceptible to jarring or knocking in this exposed position. Without some structural means to anchor the arm in the proper position and to bear at least part of the weight of the burner, it has been found that misalignment of the burner occurs quite frequently.

We have further discovered that it is highly desirable to create interchangeable parts amongst different water heaters to increase production flexibility and decrease costs. This has been a problem especially as related to interchangeability in gas fired water heaters. The burner mounting arms as well as the burners can be different, thereby requiring different mounting or support means.

There has been the further problem of securing in place the water heater radiation shield located beneath the burner. Various methods of securing the shield from below are known, but no satisfactory device is known to secure the shield from above.

OBJECTS OF THE INVENTION

Thus, it is an object of the present invention to provide a burner mounting bracket with means to strengthen the bracket against bending or breaking and to bear a portion of the load from the burner mounting arm and the burner, adaptable to receive burner mounting arms of varying constructions for gas fired water heaters.

It is a further important object of the present invention to provide a burner mounting bracket capable of securing a radiation shield in place from above.

SUMMARY OF THE INVENTION

The present invention provides a burner mounting bracket which can be quickly and easily punched out of sheet metal for supporting a burner mounting arm for a gas fired burner, having novel means which strengthens the bracket against bending or breaking, which bears a substantial portion of the burner weight, and which is capable of rigidifying a radiation shield in a desired position.

DESCRIPTION OF A PREFERRED EMBODIMENT

Figure 1:
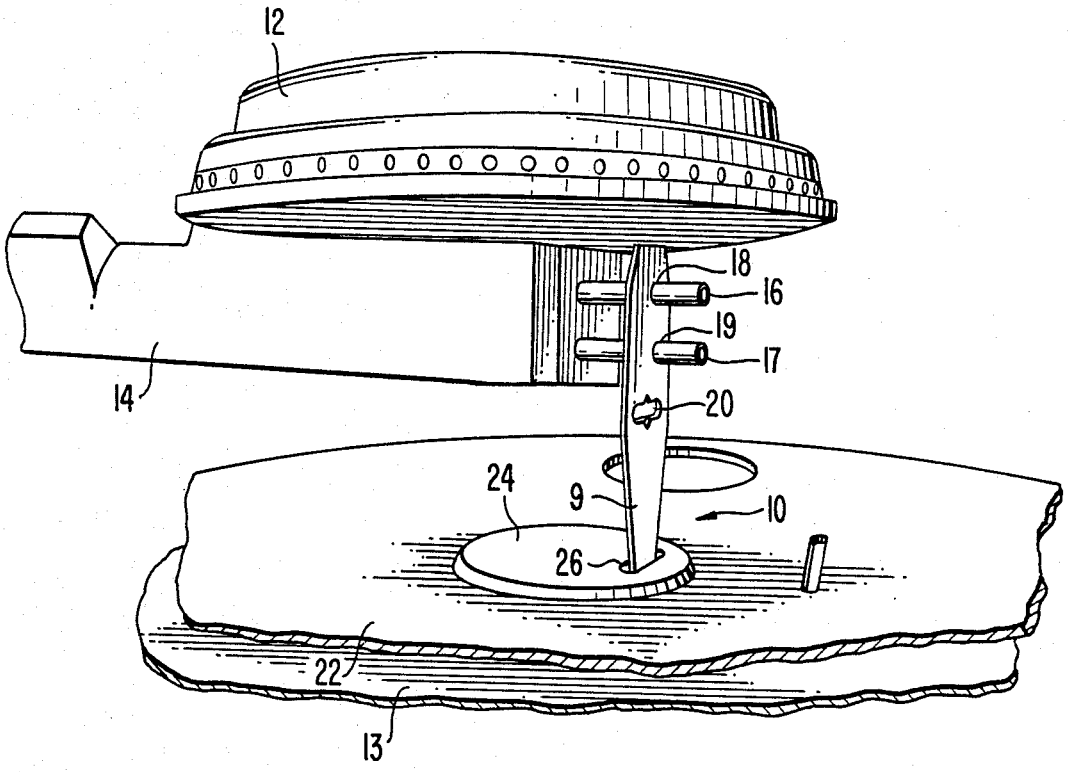
FIG. 1 depicts in perspective one embodiment of this invention showing the upper portion of a burner mounting bracket supporting a burner mounting arm with a burner mounted thereon.

Although specific embodiments of the invention have been selected for illustration in the drawings and though specific terms will be used in the description which follows, such selection and terms are not intended to limit the scope of the invention, which is defined in the appended claims.

Referring to FIG. 1, a support plate 9 is part of burner mounting bracket 10. Gas fired integral venturi-tube burner 12 has a venturi portion 14 (shown broken away). Venturi portion 14 supports the burner 12 and has mounting rods 16 and 17 which are inserted into support member holes 18 and 19. Hole 20 is provided to receive a rod from another type of burner mounting arm further to be described hereinafter. Thus, burner 12 and venturi portion 14 are placed in a desired position within the combustion chamber of the water heater and supported by burner mounting bracket 10.

Burner mounting bracket 10 extends through slot 26 in radiation shield 22 and is anchored to base 36 (shown in FIGS. 4 and 5) which is attached to base pan 13 of the water heater. Raised embossment 24 is provided on radiation shield 22 to prevent condensates from flowing downward through slot 26.

Figure 2:
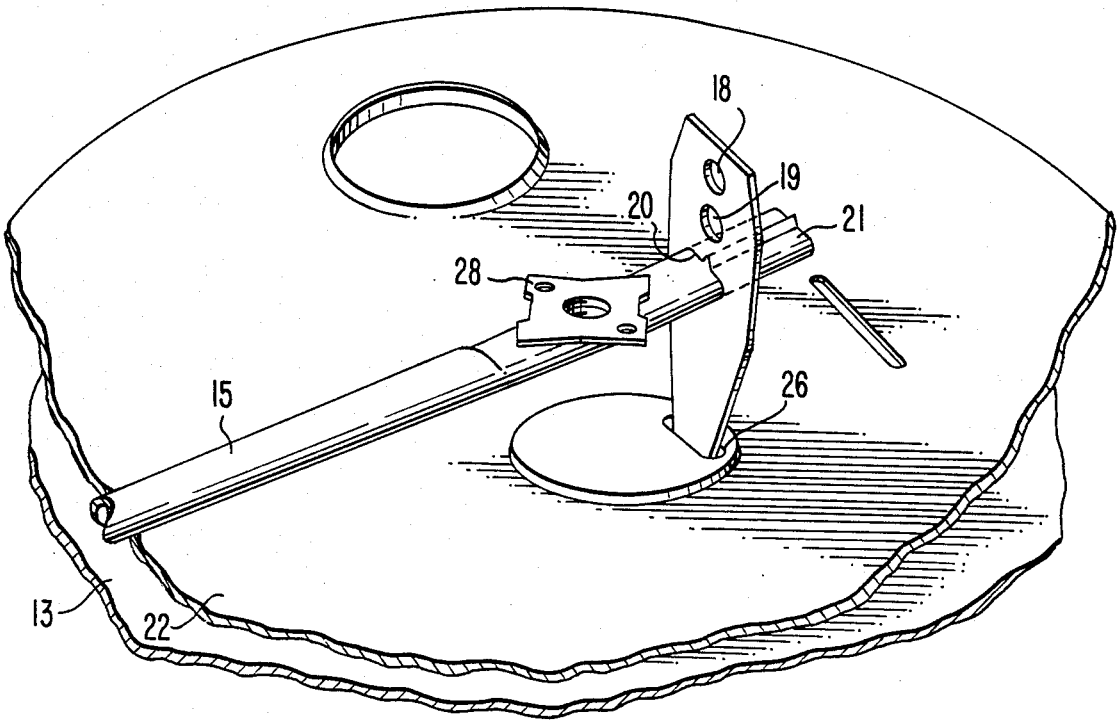
FIG. 2 shows in perspective, with parts removed for ease of understanding, the upper portion of a burner mounting bracket and support.

FIG. 2 shows another use mode wherein hole 20 through burner mounting bracket 10 supports a gas supply pipe 15 having a burner mount 28 adapted to receive a stamped steel burner (not shown). In this mode the support member holes 18 and 19 are unused, while hole 20 (previously described in connection with FIG. 1) receives mounting rod extension 21 to support burner mounting arm 15. As in FIG. 1, bracket 10 which is attached to base pan 13 extends upward through slot 26 in radiation shield 22.

Figure 3:
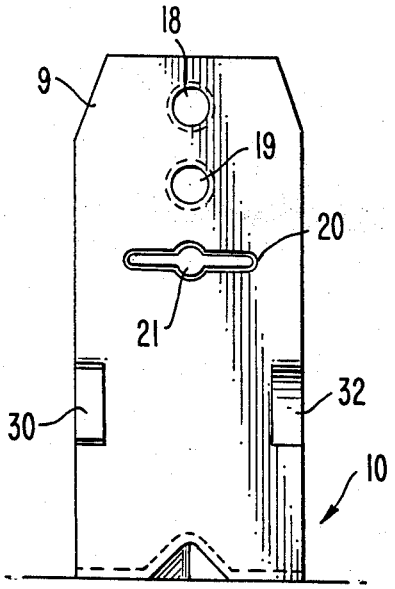
FIG. 3 is a frontal view of a burner mounting bracket comprising one embodiment in accordance with this invention.
Figure 4:
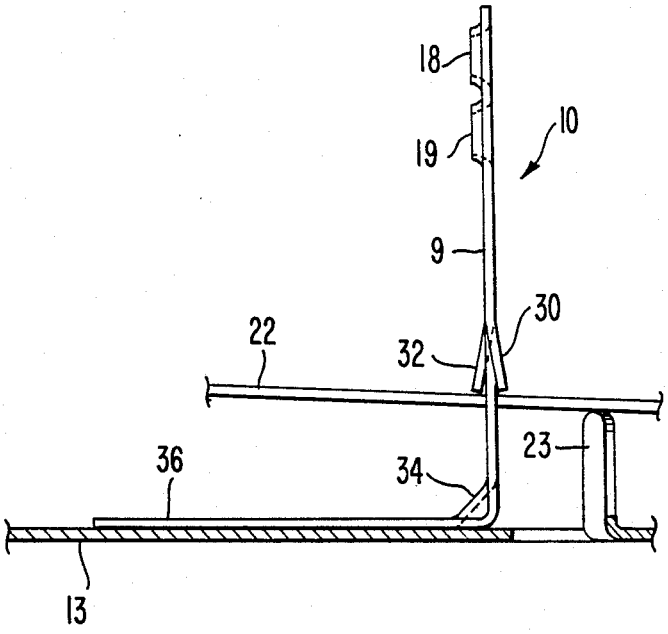
FIG. 4 represents a view in side elevation of the same burner mounting bracket shown in its relationship with the bottom pan and the radiation shield.
Figure 5:
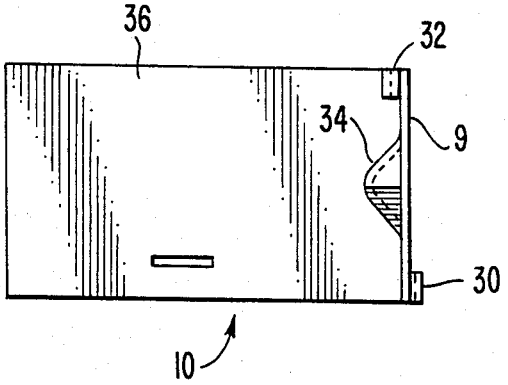
FIG. 5 depicts a top plan view of the burner mounting bracket of FIG. 3.
Figure 6:
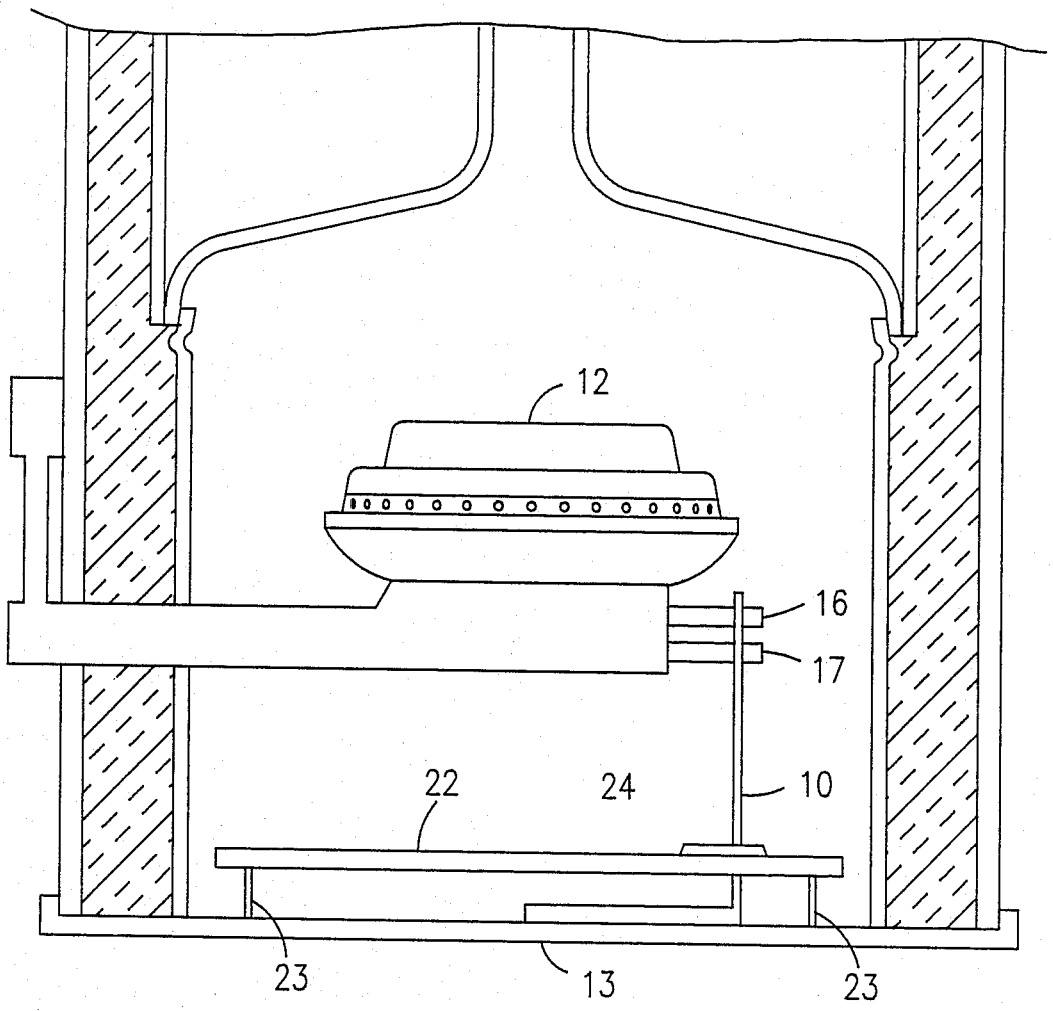
FIG. 6 shows the burner and bracket in a conventional hot water heater.

FIGS. 3, 4 and 5 show details of burner mounting bracket 10. Support member 9 contains support member holes 18 and 19 and hole 20 for receiving various types of mounting rods such as mounting rods 16 and 17 (from FIG. 1) and mounting rod extension 21 (from FIG. 2). Mounting rod extension 21 is inserted into and extends through hole 20.

Tabs 30 and 32 are provided to rigidify radiation shield 22 in a desired position in connection with support means 23 that are provided by base pan 13 of the water heater. The radiation shield 22 is spaced apart from the base pan to help retain heat. Tabs 30 and 32 are preferably angled in opposite directions from each other, although opposite angling is not necessary.

Reinforcing rib 34 is provided to strengthen the connection between support member 9 and base 36 against bending or breaking. Burner mounting bracket 10 is depicted as having a one piece construction. One piece construction is not necessary, but is preferred. The preferred material for constructing burner mounting bracket 10 is heavy gauge sheet metal so as to provide further strength.

Although this invention has been described in connection with specific forms thereof, it will be appreciated that a wide array of equivalents may be substituted for the specific elements shown and described herein without departing from the spirit and scope of this invention as described in the appended claims.

We claim:

1. A heavy gauge sheet metal burner mounting bracket for supporting a burner mounting arm or burner mounting means in a gas fired water heater, said water heater including a heat or combustion chamber having a radiation shield located therewithin, said bracket comprising a base and a support member extending upwardly from said base and having a plurality of holes extending therethrough which are positioned to receive a portion of said mounting arm or said mounting means, said support member having a plurality of tabs extending therefrom wherein said tabs fix said radiation shield in a desired position above said base spaced apart from said combustion chamber, said bracket including a reinforcing rib for rigidifying said support member in said upwardly extending position.

2. A bracket as defined in claim 1 wherein said support member extends upwardly from said base at about a 90° angle.

3. A bracket as defined in claim 1 wherein a lower support member hole is larger than an upper support member hole.

4. A bracket as defined in claim 1 wherein a portion of a lower support member hole is a rectangular slot.

5. A bracket as defined in claim 1 wherein said tabs angle away from each other.

* * * * *